US006994599B2

(12) United States Patent
Shurdan

(10) Patent No.: US 6,994,599 B2
(45) Date of Patent: Feb. 7, 2006

(54) SNAG FREE CABLE CLAMP

(76) Inventor: Charles Shurdan, 1409 Grogan Rd., Starkville, MS (US) 39759

( * ) Notice: Subject to any disclaimer, the term of this patent is extended or adjusted under 35 U.S.C. 154(b) by 0 days.

(21) Appl. No.: 11/055,529

(22) Filed: Feb. 10, 2005

(65) Prior Publication Data

US 2005/0191898 A1 Sep. 1, 2005

Related U.S. Application Data

(60) Provisional application No. 60/543,383, filed on Feb. 10, 2004.

(51) Int. Cl.
*H01R 11/24* (2006.01)

(52) U.S. Cl. ..... 439/822; 439/759; 439/829

(58) Field of Classification Search ..... 439/822, 439/759, 506, 729, 835, 829
See application file for complete search history.

(56) References Cited

U.S. PATENT DOCUMENTS

| | | | | |
|---|---|---|---|---|
| 408,785 | A | 8/1889 | Zoeller | |
| 1,999,613 | A * | 4/1935 | Mueller et al. | 439/822 |
| 3,031,642 | A * | 4/1962 | Gartner, Jr. | 439/822 |
| 4,072,388 | A | 2/1978 | Dunn | |
| 4,163,134 | A | 7/1979 | Budrose | |
| 4,826,457 | A * | 5/1989 | Varatta | 439/755 |
| 4,923,415 | A | 5/1990 | Lee | |
| 5,230,637 | A | 7/1993 | Weber | |
| 5,618,210 | A | 4/1997 | Grant | |

* cited by examiner

*Primary Examiner*—Tho D. Ta
(74) *Attorney, Agent, or Firm*—Wyatt, Tarrant & Combs, LLP

(57) ABSTRACT

A clamp for an electrical cable, such as a jumper cable utilized to jump start vehicles when the battery is dead. The clamp has a snag-free construction wherein the clamping arm to which the cable is attached extends through a slotted, downwardly projecting extension of the pivotally-attached cooperating arm such that the cable has a clear exit path of the cable. The cooperating arm also presents an angular aspect such that the gripping portion of the arm is closer to the other arm than in conventional clamps, and in the preferred embodiment the gripping portion of the arms are approximately parallel in the plane in which they lie.

13 Claims, 3 Drawing Sheets

SNAG FREE CABLE CLAMP

CROSS REFERENCE TO RELATED APPLICATIONS

This application claims priority of U.S. Provisional Patent Application Ser. No. 60/543,383, filed Feb. 10, 2004, which application is fully incorporated herein by reference.

STATEMENT REGARDING FEDERALLY SPONSORED RESEARCH OR DEVELOPMENT

Not applicable

REFERENCE TO A MICROFICHE APPENDIX

Not applicable

FIELD OF THE INVENTION

The present invention relates to clamping devices, and more particularly to a snag-free clamp for use on electrical cables for a quick, facile connection for temporary or short term application such as jumper cables, welding machine leads, hospital devices, and the like.

BACKGROUND OF THE INVENTION

Spring clamps are widely used for a variety of applications. While spring clamps come in a wide variety of formats, they generally consist of a pair of jaws that are pivotally connected to one another. Each jaw is connected to a handle. A spring is positioned within the handles such that the spring normally biases the jaws together in a closed configuration. When pressure is applied to squeeze the handles toward one another, the jaws are pulled into an open configuration. When pressure is released, the spring forces the jaws to snap shut.

One particular type of application for spring clamps is on electrical cables for a quick and easy attachment to a power or signal source such as automotive jumper cables. Jumper cables are widely used to jump-start vehicles such as automobiles and trucks having dead batteries. Prior art jumper cables typically include two lengths of insulated battery cable and four spring clamps. A spring clamp is fixed to each end of each length of cable. The jumper cables are usually fixed to one another along most of their lengths in order to minimize tangling of the cables.

The present invention relates in general to an improved jumper cable construction and is concerned, more particularly, with jumper cables that are safe and easy to use. Conventional jumper cable clamps have open ends, or protruding handles that can become caught and tangled with each other. If the open ends of conventional jumper cable clamps become hooked to one another while the opposing ends of the cable claps are attached to the terminals of a battery, it is possible for the open or exposed conductor of which to enable current to short circuit or loop through the cables, creating sparks and other potentially dangerous circumstances. Additionally, the open ends of conventional jumper cable clamps can become caught on the cables, which promotes tangling of the cables and adds to the difficulty of use, requiring undue delay in their application. Jumper cables are often needed in difficult conditions, such as during cold weather, during storms, or during the night. In these situations, preventing cables from becoming caught on each other and tangled together can ease and speed up the process of jumping a vehicle, thus allowing users to more readily extricate themselves from difficult or dangerous situations.

Another drawback of prior art jumper cable clamps is that there is a wide-separation between the top and bottom handles, which makes it difficult to get a grip on the clamp, particularly for people who have small hands or diminished grip strength. The separation is caused by the configuration of the handles, each of which is set at about 180 degrees (or in line with) relative to its respective jaw.

There is thus a need for a jumper cable clamp having the following characteristics and advantages over the prior art.

PREFERRED EMBODIMENTS OF THE INVENTION

In the following detailed description of the preferred embodiments, reference is made to the accompanying drawings which form a part hereof, and in which are shown by way of illustration specific embodiments in which the invention may be practiced. It is to be understood that other embodiments may be utilized and structural changes may be made without departing from the scope of the present invention.

Figure 1:
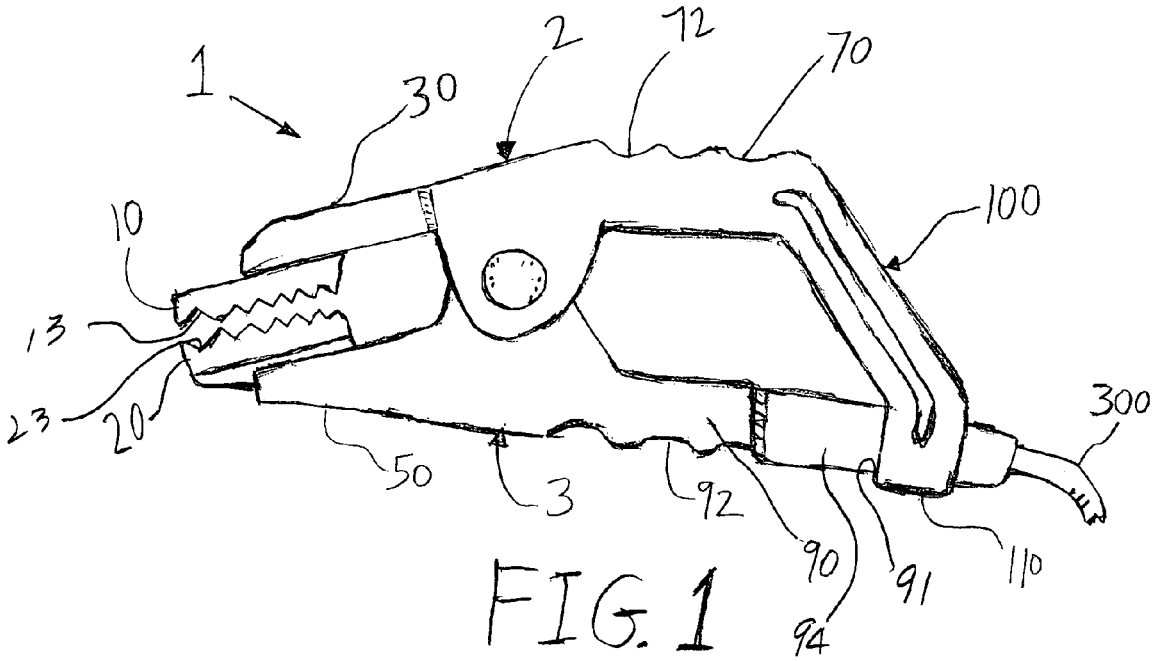
FIG. 1 is a side view of one preferred embodiment of the jumper cable clamp of the invention, showing the clamp in a closed position.
Figure 3:
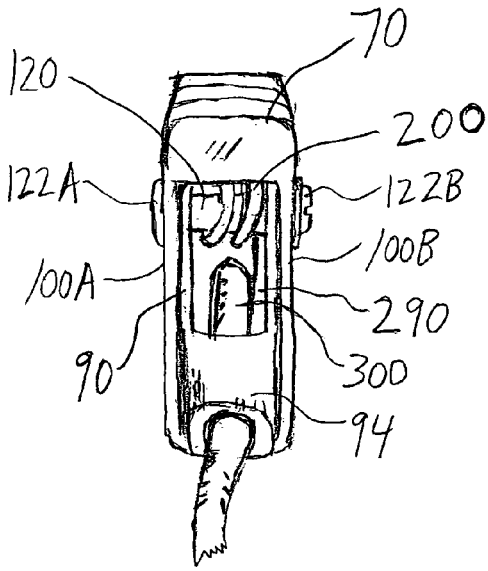
FIG. 3 is a rear view of one preferred embodiment of the jumper cable clamp of the invention, showing the claim in a closed position.
Figure 2:
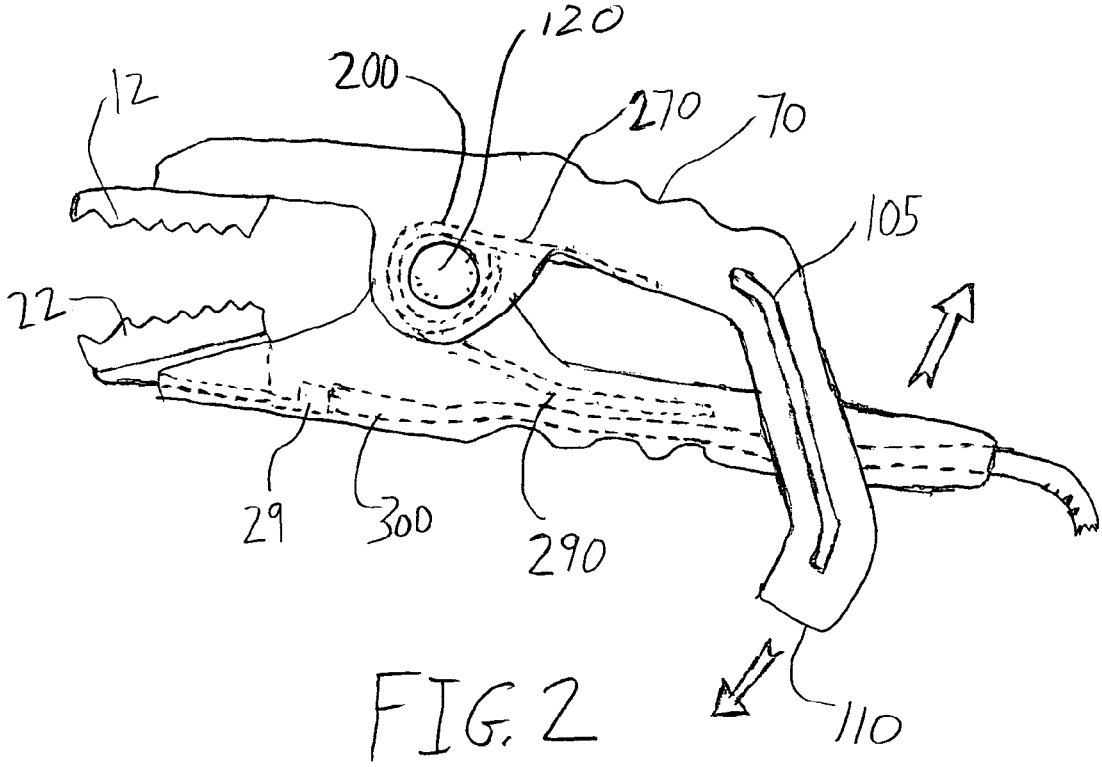
FIG. 2 is a side view according to FIG. 1, showing the clamp in an open position and featuring phantom views of internal spring and cable components of the device.

As shown in FIG. 1, the snag-free clamp of the invention 1 generally comprises a clamp having an upper lever member 2 pivotally connected to and biased against a lower lever member 3 such that an upper handle 70 of the upper lever member 2 extends generally parallel to a counterpart handle 92 on the lower lever member 3. Handle 70 extends downwardly from its parallel orientation in a fenestrated extension 100 to a closed retaining portion 110 engaging the bottom surface 91 of a lower handle 90 of the lower lever member 3. As shown in FIGS. 2 and 3, a spring 200 is positioned around a pivot shaft 120 such that an upper handle spring extension portion 270 and a lower handle spring extension portion 290 of the spring normally bias an upper jaw 30 of the upper lever member 2 and a lower jaw 50 of the lower lever member 3 into a closed position. However, as shown most clearly in FIGS. 1 and 5, in a preferred embodiment, the retaining portion 110 prevents the upper 30 and lower 50 jaws from physically contacting one another by preventing the spring 200 from fully uncoiling to its unbiased position. Thus, the bottom rear portion 110 of the upper handle 70 provides a positive stop when released, which prevents the conductive metal teeth 10, 20 of the jaws from jamming together and getting damaged or misaligned, unlike prior art jumper cable clamps.

Figure 4:
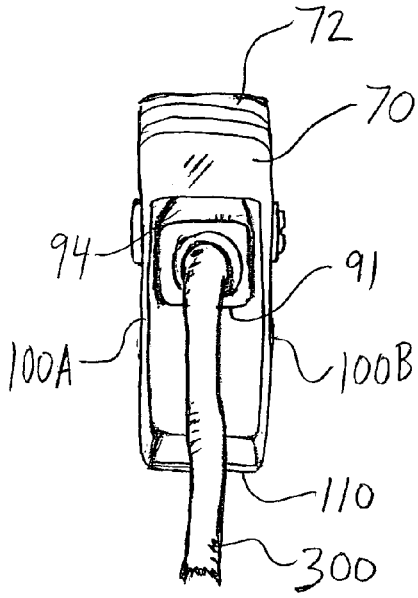
FIG. 4 is a rear view according to FIG. 3, showing the clamp in an open position.

As shown most clearly in FIG. 4, the fenestration of downward extension 100 of the upper handle 70 is preferably formed from a first downward extension 100A and a second downward extension 100B. The first and second downward extensions 100A, 100B are joined by a catch or retaining portion 110. When the device 1 is molded from plastic (a preferable embodiment), the first downward extension 100A, the second downward extension 100B, and the catch portion 110 form a unitary structure of considerable strength. As shown in FIGS. 1 and 2, ribs 105 may be formed on the outside of the downward extension 100 of the upper handle 70 in order to strengthen the first and second downward extensions 100A, 100B.

As shown in FIG. 1, the lower handle 90 is preferably provided with a rear inset portion 94 having a width reduced from that of handle 90. The rear inset portion 94 preferably has this narrower width than the lower handle 90, such that the rear inset portion 94 fits within the opposing first and second downward extension portions 100A, 100B of the upper handle 70. This configuration enables an increase in the size and strength of the hand grip portion 92 of the lower handle 90.

As can be further seen in FIG. 1, the upper handle 70 is angled, or offset from the axis of upper jaw 30. This configuration reduces the distance between the upper and lower handles 70, 90, which makes it easier to apply compression to the handles, particularly for individuals who have small hands or reduced grip strength. The upper handle 70 is preferably offset from the upper jaw 30 at an angle of between about 15 and 25 degrees, and preferably about 20 degrees. Additionally, the downward extension 100 of the upper handle 70 is offset from both the upper jaw 30 and the grip portion 72 of the upper handle 70. The downward extension 100 is preferably offset from the grip portion 72 of the upper handle 70 by about 45 to 60 degrees, and preferably by about 55 degrees.

Grips 72, 92 are preferably provided on the handles 70, 90 to keep the hand of a user from slipping. In a preferred embodiment, the grips 72, 92 are about ½ inch wide and about ⅛ inch deep. They may be molded or otherwise formed into the plastic or material from which the handles 70. 90 are made, and may further have applied thereto a texturized surface (knurling or a non-slip surface) to enhance the grip of the user.

As shown in FIGS. 1, 2, 5 and 6, the upper jaw 30 is provided with a conductive surface such as upper metal teeth 10, while the lower jaw 50 is provided with lower metal teeth 20. The upper metal teeth 10 preferably have a serrated edge 12, while the lower metal teeth 20 are also provided with a serrated edge 22. The serrated edges 12, 22 assist in engaging the conductive surface of the contact to be made, such as a battery post. A larger notch 13, 23 may be provided on the end of the teeth 12, 22 to assist in engaging a side mounted battery post. The teeth preferably open wider than those of conventional jumper cable clamps. The teeth 12, 22 are preferably formed from a metal of sufficient hardness to prevent them from deformation such as bending during use. The teeth 12,22 are preferably made from a copper alloy of about 1/16 inch thick. Conventional jumper cables often use a soft metal that becomes damaged during use, and particularly after extended use.

Figure 5:
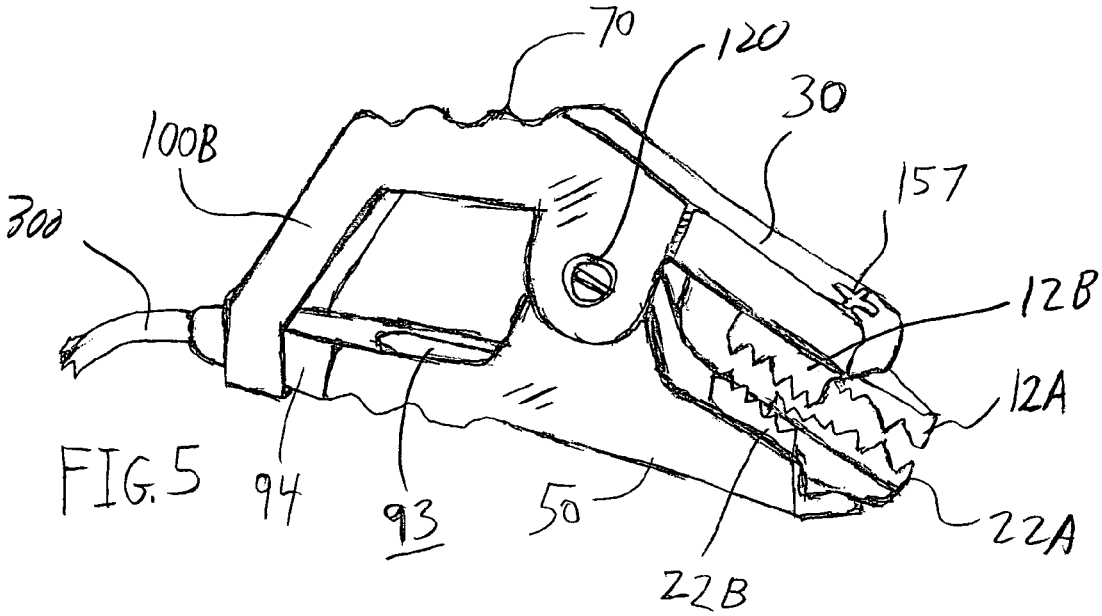
FIG. 5 is a side perspective view of one preferred embodiment of the jumper cable clamp of the invention, showing the clamp in a closed position and featuring details of one preferred embodiment of the metal jaw components of the device.

Additionally, as shown in FIGS. 1, 2 and 5, the upper metal teeth 10 preferably extend beyond the upper jaw 30, while the lower metal teeth 20 preferably extend beyond lower jaw 50. The configuration facilities gripping of contacts having other adjacent structure such as the vehicle parts located near battery posts.

Figure 6:
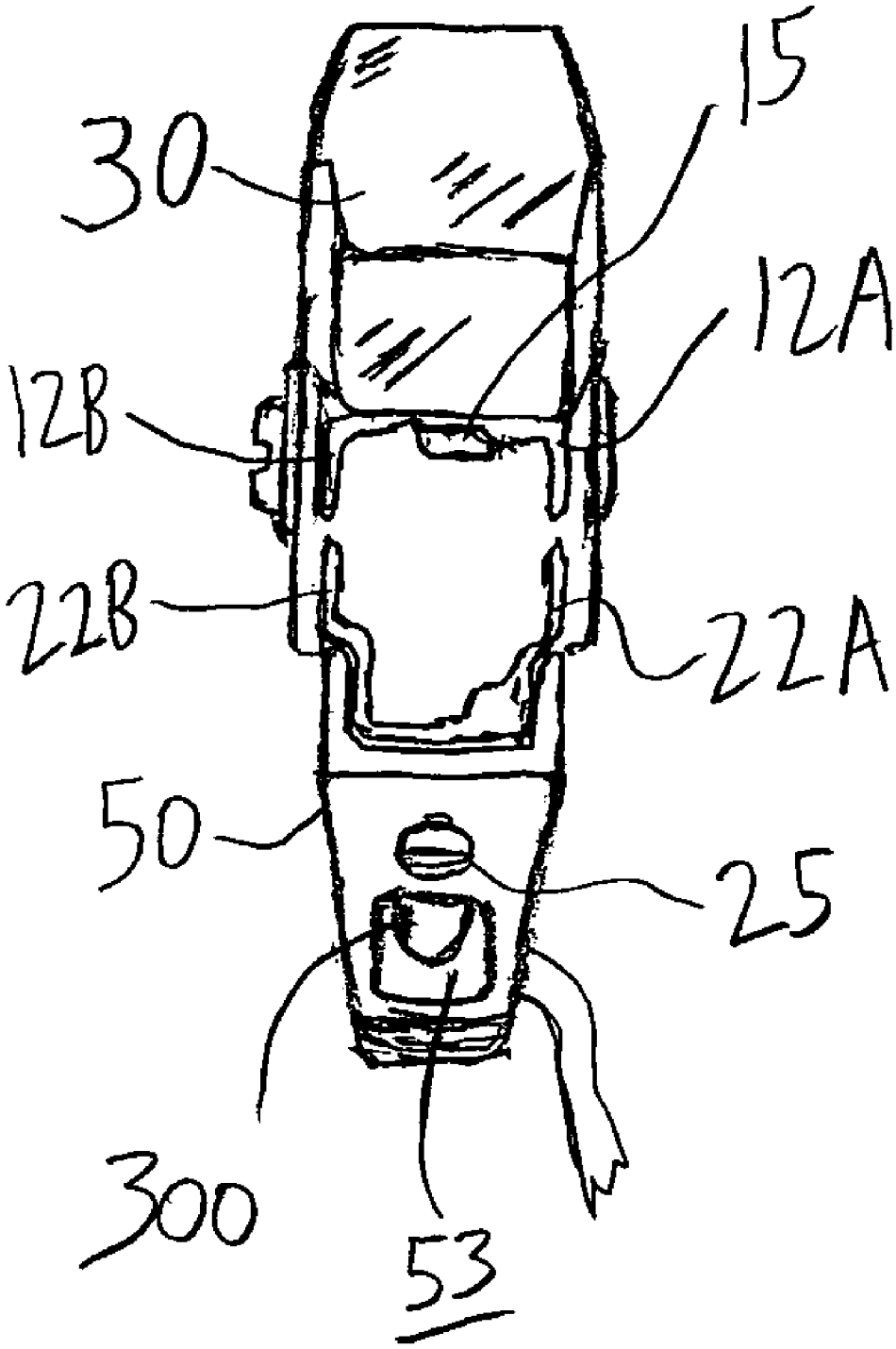
FIG. 6 is a front view of one preferred embodiment of the jumper cable clamp of the invention, showing the clamp in a closed position and featuring details of one preferred embodiment of the metal jaw components of the device.

FIGS. 5 and 6 show preferred features of the upper and lower teeth 10, 20. As shown in FIG. 5, the upper metal teeth 10 are preferably provided with opposing pairs of serrated edges 12A, 12B, while the lower metal teeth 20 are preferably provided with opposing pairs of serrated edges 22A, 22B. As shown in phantom lines in FIG. 2, the lower metal teeth 20 are preferably coupled to the cable 300 by a coupling portion 29, which extends rearwardly from the lower metal teeth 20.

FIG. 6 provides a frontal view of a preferred structure of the upper and lower metal teeth 10, 20. As indicated in FIG. 6, each set of metal teeth 10, 20 is preferably formed from a unitary piece of metal having a flat center portion and a pair of extensions terminating in serrated edges 12A, 12B, 22A, 22B. The upward extensions 22A, 22B of the lower metal teeth 20 are preferably configured to fit tightly within a channel 93 in the lower handle 90. In a preferred embodiment shown in FIG. 5, the metal teeth 10, 20 are configured such that one side of the serrated edges 12A, 22A extends beyond the jaws 30, 50, while the other side of the metal teeth 12B, 22B does not extend beyond the jaws 30, 50.

Note that in the preferred embodiment shown in FIG. 1, the serrated edges 12A, 12B of the upper teeth 10 are not angled relative to the base or span of the upper teeth 10, while the serrated edges 22A, 22B of the lower teeth 20 are angled relative to the base or span of the lower teeth 20. Alternatively, the lower teeth 20 can be configured such that the serrated edges 22A, 22B are not angled. In other words, the lower teeth 20 can be configured in the manner of the upper teeth 10 shown in FIG. 1.

The upper metal teeth 10 are preferably molded into the plastic of the upper jaw 30. Alternatively, as shown in FIG. 6, a fastening means 15 is provided for fixing the upper metal teeth 10 on the upper jaw 30. The means 15 is preferably two screws, but other well-known fasteners such as bolts, rivets, or glue, could be used. The screws 15 are preferably threaded directly into the upper jaw 30.

As further shown in FIG. 6, a fastening means 25 is also provided for fixing the lower metal teeth 20 on the lower jaw 50. The means 25 is preferably a single rivet. Alternatively, a screw, or a bolt and nut combination with the nut positioned on the upper surface of the lower jaw 50 and the head of the bolt countersunk into the bottom surface of the lower jaw 50, can be used.

In a preferred embodiment, each of the upper and lower lever members 2, 3 are formed or molded as unitary structures from a non-conductive material, such as hard plastic. Conventional jumper cable clamps are made of metal. With the upper and lower 2, 3 members molded from plastic, the only parts of the clamp 1 that can conduct electricity are the metal teeth 10, 20. This configuration lowers the risk of shock or the arcing of current during use. Additionally, the metal jaws and handles of conventional jumper cable clamps are covered with a plastic or rubber coating. This adds to the cost of manufacture, and such coatings can tear or otherwise break down over time. Additionally, the use of colored plastics eliminates the need to paint the device 1.

A conventional cable 300 is coupled to the lower metal teeth 20. The cable is insulated along most of its length, in the manner of conventional jumper cables. With conventional jumper cables, the two cables are often joined together along most of their lengths in order to reduce tangling and loss of one of the cables, and this configuration can be employed in the invention. Although the illustrated invention 1 is primarily designed for use with jumper cables, it can be used with other types of cables that require a clamp connection, such as welding cables or cables used with hospital devices.

As indicated in FIGS. 1 and 4, the lower handle 90 is provided with a cable bore through which the cable 300 passes. The cable bore can be sized such that it slip fits different gauges of cable 300. As indicated in FIG. 5, a lengthwise channel 93 is preferably formed in an upper side of the lower jaw 50 to provide access to the bore. As indicated in FIG. 2, the lower handle extension portion 290 of the spring 200 sits in the channel 93 and is supported by a surface within the channel 93, such as the cable 300. In this embodiment, the lower handle extension portion 290 of the spring serves to secure the cable in the lower handle 90, reducing stress on the connection between the cable 300 and the lower metal teeth 20. A conventional heavy rubber or plastic coating on the cable resists any wear and tear that occurs from compression of the spring 200 and use of the device 1.

As shown in FIGS. 3 and 4, fastening means 122A, 122B are provided for securing the pivot shaft 120 on the upper 2 and lower 3 lever members. In the embodiment shown in FIG. 3, a first fastening means 122A is a bolt having a thickened shaft with internal threads, while second fastening means 122B is a screw threaded into the shaft of the first fastening means 122A. The pivot shaft 120 is preferably a press fit rivet, such as a 0.001 or 0.002 press fit rivet. The use of a rivet makes the device 1 easier to manufacture and avoids potential problems with nuts coming loose.

As shown in FIG. 5, the jumper cable clamp of the invention 1 can be provided with charge indicia 157, e.g. "+" or "−". As shown in FIG. 5, the charge indicia 157 are preferably positioned on an upper surface of the upper jaw 30, such that they are readily visible to a user during use. When the device 1 is made of plastic, the charge indicia 157 can be molded into the device 1.

In operation, the device of the invention is used in the manner of conventional jumper cables. A user places his or her hand on the handles 70, 90, the heel of the hand contacting one of the handles and the fingers grasping the other, applies compressive force to open the jaws 30, 50, places the jaws 30, 50 around a battery post, and then releases pressure, allowing the jaws 30, 50 to close on the battery post. This procedure is completed until all four clamps 1 are properly positioned on the dead and live batteries or the frame of the vehicle. Once the dead battery has been jump-started in the conventional manner, the user removes the clamps 1 by depressing the handles 70, 90.

Although the present invention has been described in terms of specific embodiments, it is anticipated that alterations and modifications thereof will no doubt become apparent to those skilled in the art. It is therefore intended that the following claims be interpreted as covering all alterations and modifications that fall within the true spirit and scope of the invention.

What is claimed is:

1. A clamp for an electrical cable comprising:

a first clamping arm having a clamping end and a second end;

a second clamping arm having a clamping end and a second end, pivotally attached to the first clamping arm, said pivotal attachment being intermediate the ends of each of the clamping arms;

spring means disposed in the pivotal attachment for biasing the clamping ends of the clamping arms toward a closed position;

the second clamping arm having the cable attached to the second end of the second cable arm;

the second end of the first clamping arm having an extension, angularly disposed toward the second end of the second arm, said extension having an opening therein for receiving the second end of the second arm therethrough whereby the cable attached to the clamp is precluded from becoming entangled with the arms of the clamp.

2. The clamp according to claim 1 wherein the respective ends of the first clamping arm form an obtuse angle of less than 180 degrees.

3. The clamp according to claim 2 wherein the respective ends of the first clamping arm form an obtuse angle of about 155 to about 165 degrees.

4. The clamp according to claim 3 wherein the respective ends of the first clamping arm form an obtuse angle of about 160 degrees.

5. The clamp according to claim 1 wherein the first clamping arm extension forms an obtuse angle with the second end of the clamping arm.

6. The clamp according to claim 5 wherein the obtuse angle between the clamping arm extension and the second end is from about 120 degrees to about 135 degrees.

7. The clamp according to claim 6 wherein the obtuse angle between the clamping arm extension and the second end is from about 125 degrees.

8. The clamp according to claim 1 wherein the second end of the second clamping arm extends through the opening in the extension of the second end of the first clamping arm.

9. The clamp according to claim 8 wherein the opening in the extension of the second end of the first clamping arm is a slot whereby when the clamping arms are pivoted such that the clamping ends are opened, the second end of the second clamping arm articulates freely within the opening.

10. The clamp according to claim 1 wherein the electrical cable is connected to the clamping end of the second clamping arm.

11. The clamp according to claim 1 wherein the second ends of the first and second clamping arms have griping surfaces disposed thereon.

12. The clamp according to claim 1 wherein the clamping end of the second arm has an electrically conductive gripping surface thereon.

13. The clamp according to claim 12 wherein the electrical cable is connected to the electrically conductive gripping surface.

* * * * *

UNITED STATES PATENT AND TRADEMARK OFFICE

CERTIFICATE OF CORRECTION

PATENT NO. : 6,994,599 B2
DATED : February 7, 2006
INVENTOR(S) : Charles Shurden It is certified that error appears in the above-identified patent and that said Letters Patent is hereby corrected as shown below:

Title page,
Item [75], Inventor, should read -- Charles Shurden --.

Signed and Sealed this

Eleventh Day of April, 2006

JON W. DUDAS
*Director of the United States Patent and Trademark Office*